US010240903B2

(12) United States Patent
Coe et al.

(10) Patent No.: US 10,240,903 B2
(45) Date of Patent: Mar. 26, 2019

(54) PROJECTILE COLLECTION SYSTEM

(71) Applicant: Action Target Inc., Provo, UT (US)

(72) Inventors: Walter Coe, Springville, UT (US); Darren Wall, Payson, UT (US); Tim Hakala, Lindon, UT (US); Kevin Tomaszewski, Draper, UT (US)

(73) Assignee: Action Target Inc., Provo, UT (US)

( * ) Notice: Subject to any disclaimer, the term of this patent is extended or adjusted under 35 U.S.C. 154(b) by 0 days.

(21) Appl. No.: 15/385,654

(22) Filed: Dec. 20, 2016

(65) Prior Publication Data

US 2017/0205209 A1 Jul. 20, 2017

Related U.S. Application Data

(60) Provisional application No. 62/278,926, filed on Jan. 14, 2016.

(51) Int. Cl.
*F41J 13/00* (2009.01)
*F41J 13/02* (2009.01)

(52) U.S. Cl.
CPC ..... *F41J 13/00* (2013.01); *F41J 13/02* (2013.01)

(58) Field of Classification Search
CPC ..... F41J 13/00; F41J 13/04; F41J 13/02
USPC ..... 273/404, 410
See application file for complete search history.

(56) References Cited

U.S. PATENT DOCUMENTS 3,232,419 A * 2/1966 Rasmussen ..... B24C 7/0092 198/661
3,707,224 A * 12/1972 Rastoin ..... B65G 33/00 198/659
3,982,408 A 9/1976 Wright
4,266,830 A * 5/1981 Retka ..... E21B 10/44 173/DIG. 2
4,786,059 A * 11/1988 Barini ..... F41J 13/00 273/403
5,085,765 A * 2/1992 Salabe ..... F41J 13/00 209/147
5,823,123 A * 10/1998 Waldner ..... B65G 33/14 110/257

(Continued)

FOREIGN PATENT DOCUMENTS

JP 2001132770 A * 5/2001

OTHER PUBLICATIONS

Action Target drawings of auger collection system installed at Orlando Police Department, circa 2010.

*Primary Examiner* — Mark Graham

(74) *Attorney, Agent, or Firm* — Durham Jones & Pinegar; Sarah Matthews; Randall B. Bateman

(57) ABSTRACT

A lead collection system and method for reducing the incidence of equipment failures, equipment breakages, and/or safety hazards is provided. The lead collection system may include one or more augers that carry lead to a lead containment barrel. The auger(s) may be equipped with a specialized shear coupling designed such that the shear coupling breaks and stops auger movement before the auger may break. The auger(s) may also be equipped with one or more rotational sensors to detect actual shaft speed and compare it to the inputted speed, and cause a system error if a difference is detected. A lead containment barrel may also be provided, with an ultrasonic sensor for detecting lead fill in the barrel.

17 Claims, 11 Drawing Sheets

(56) References Cited

U.S. PATENT DOCUMENTS

| | | | | |
|---|---|---|---|---|
| 2005/0034594 | A1* | 2/2005 | Parks | F41J 13/00 89/1.11 |
| 2005/0232738 | A1* | 10/2005 | Moran | B65G 33/02 414/618 |
| 2009/0096173 | A1* | 4/2009 | Bateman | B23K 11/0053 273/410 |
| 2009/0255955 | A1* | 10/2009 | Jung | B65G 33/14 222/63 |
| 2014/0343723 | A1* | 11/2014 | Meier | B65G 43/00 700/230 |
| 2015/0033592 | A1* | 2/2015 | Kanbara | E01H 5/098 37/258 |
| 2016/0174465 | A1* | 6/2016 | Kohls | A01D 41/1217 414/518 |
| 2016/0209057 | A1* | 7/2016 | Stolworthy | F41J 13/02 |
| 2016/0376107 | A1* | 12/2016 | Beaujot | B65G 15/00 177/1 |

* cited by examiner

PROJECTILE COLLECTION SYSTEM

BACKGROUND OF THE INVENTION

State of the Art

The present invention relates to a lead collection system and a method to reduce the incidence of projectile collection issues, which may cause dangerous situations and expensive equipment malfunctions.

When shooters practice at gun ranges, projectiles such as lead bullets, are shot at targets and collected into bullet traps. The bullet traps may consist of hardened steel which deflects the bullets so they can be disposed of in an environmentally responsible manner. Lead bullets and bullet fragments collect in the bottom of the bullet traps or pass through an outlet. While conventionally a bucket or some other container was disposed under the outlet, more advanced bullet traps have bullet containment systems to eliminate the need to empty numerous buckets when they become full. In modern systems, the bullets and bullet fragments may then be taken from a bullet trap to a collection barrel by various means. In some collection systems, the lead is moved to a lead containment barrel by use of an auger system. (While projectiles other than lead are used at shooting ranges, a large percentage of the bullets collected are usually lead. Thus, for convenience the bullets and bullet fragments are referred to herein as lead, even though projectiles and projectile fragments other than lead may be present.)

Because exposure to lead can be dangerous, firing ranges take precautions to limit lead exposure. For example, lead is collected into barrels to contain the lead and limit exposure. This also allows the lead to be sent for recycling with minimal contact with range personnel. Additionally, range personnel will usually use protective clothing when moving the containers full of lead.

It is undesirable for the barrels to become too full, as the lead may be compressed and form an ingot. Likewise, too much lead can simply block access to the container, thereby causing lead bullets and fragments to back up into the transport of the collection system. Additionally, too much lead collected in a barrel can lead to expensive equipment malfunctions, such binding the augers that move the lead to the barrel, thereby causing the auger to break. However, it is often difficult to determine how much lead is disposed in the barrel.

Additionally, the augers that move the lead may become stuck or slow for various reasons, including hot lead sticking to the walls of the conduit in which the auger is placed. If the drive motor continues to apply torque to the augers, additional equipment malfunctions may occur such as augers binding and/or breaking.

Replacing a bound or broken auger typically requires the range to be shut down while repairs are made, and can be both expensive and time consuming. Thus, there is a need for a system which helps to minimize the risk of damage to the lead transport system.

SUMMARY OF THE INVENTION

The present disclosure may provide a lead collection system and method of use to reduce the incidence of lead exposure and/or to reduce the incidence of equipment failures associated with lead collection. It will be appreciated that the collection system can also be used with other projectile material, as well as related debris such as wadding, etc. An invention described herein may include one or more of the features or elements summarizes herein, but is not required to unless specifically set forth in the claims.

The present disclosure includes multiple different devices, systems, methods and applications which can reduce the incidence of lead exposure and/or to reduce the incidence of equipment failures associated with lead collection and are thus applications of a common inventive concept. It should be appreciated that various devices, systems, methods and applications will have some benefits and may lack other benefits which are present in different devices, systems, methods and applications. Therefore, the teachings of the present disclosure and any actual or intended benefit of any embodiments should not be read into the claims unless expressly stated therein.

According to one aspect of the present disclosure, a lead collection system may include an auger system to move lead from a bullet trap to a lead collection barrel with the system including structures and methods to protect the auger from damage. According to another aspect, one or more systems may be provided to protect the auger system from down time due to the auger being inhibited. Furthermore, one or more systems may monitor lead or other material to minimize downtime and potential lead exposure to range personnel.

According to one aspect, the auger system may be provided with a rotational sensor. In some configurations, one or more substrates to be sensed may be placed on the shaft of the auger and a sensor that can sense the substrate may be placed proximally at a stationary location. According to another aspect, various substrate/sensor combinations are contemplated, such as a steel substrate with an inductive sensor, a magnet substrate with a Hall effect sensor, a reflective substrate with a light detecting sensor, etc. According to another aspect, one substrate/sensor may be used, or multiple substrates/sensors may be used to improve accuracy.

According to yet another aspect, the rotational sensor may sense the rotational speed of the auger and communicate with a processor. The processor may compare the measured rotational speed with a programmed speed. In some configurations, the system may be programmed to shut off the drive motor for the auger when the processor determines the measured rotational speed and the programmed speed are not the same. Such may occur, for example, when the auger is being slowed due to contact with lead-buildup on the conduit surrounding the auger.

According to another aspect, the processor may be programmed to allow a degree of error before shutting off the drive motor, or to wait a given time to see if the auger returns to its expected speed within an acceptable threshold.

According to another aspect, the auger may be provided with a shear coupling that couples the shaft of the auger to the shaft of the drive motor. The shear coupling allows one or more shear bolts to break before the auger shaft breaks or shears due to motor torque. Thus, a much less expensive part or more easily replaced part may sacrificed instead of a more expensive part or a part which is more difficult to replace.

According to another aspect, the shear coupling may be comprised of a first adapter and a second adapter, each adapter being configured for attachment to one of the drive motor shaft and/or the shaft of the auger. Each adapter may have a flange extending outwardly from the first end. The flanges may be configured to face each other and may each have one or more holes for receiving one or more shear bolts.

According to another aspect, shear bolts may be provided with a thicker, nominal diameter and a thinner, shearing diameter. The shearing diameter may be chosen based on the materials used for the system, and may be chosen such that the bolt will shear in the shearing plane before any other components of the system shear or break.

According to another aspect, the length of the shear bolt and placement of the groove that forms the shearing plane along the length of the shear bolt may be chosen such that when installed, the shearing plane is in the plane that the flanges meet. Thus, the length of bolt between the head and the groove that forms the shearing plane may be equal to or around the thickness of the flange.

According to yet another aspect, the shear coupling may also include one or more bushings, such as a flat bushing and/or a cone bushing, between the two flanges. The bushings may provide protection to the faces of the flanges when the shear bolts shear and the drive motor shaft and the auger shaft spin independently.

According to yet another aspect, a lead containment barrel may be provided with an ultrasonic sensor located thereon. The ultrasonic sensor may communicate the amount of lead it senses in the barrel to a processor, and when the processor senses the barrel is full or nearly full, the processor may shut down other aspects of the system, such as the augers, to prevent overfilling of the barrel. The ultrasonic sensor may also send fill indication warnings so the range personnel can determine the best time to replace the barrel without interrupting use of the range.

These and other aspects of the present invention are realized in a projectile collection system and method of use as shown and described in the following figures and related description.

BRIEF DESCRIPTION OF THE DRAWINGS

Various embodiments of the present invention are shown and described in reference to the numbered drawings wherein.

Figure 1:
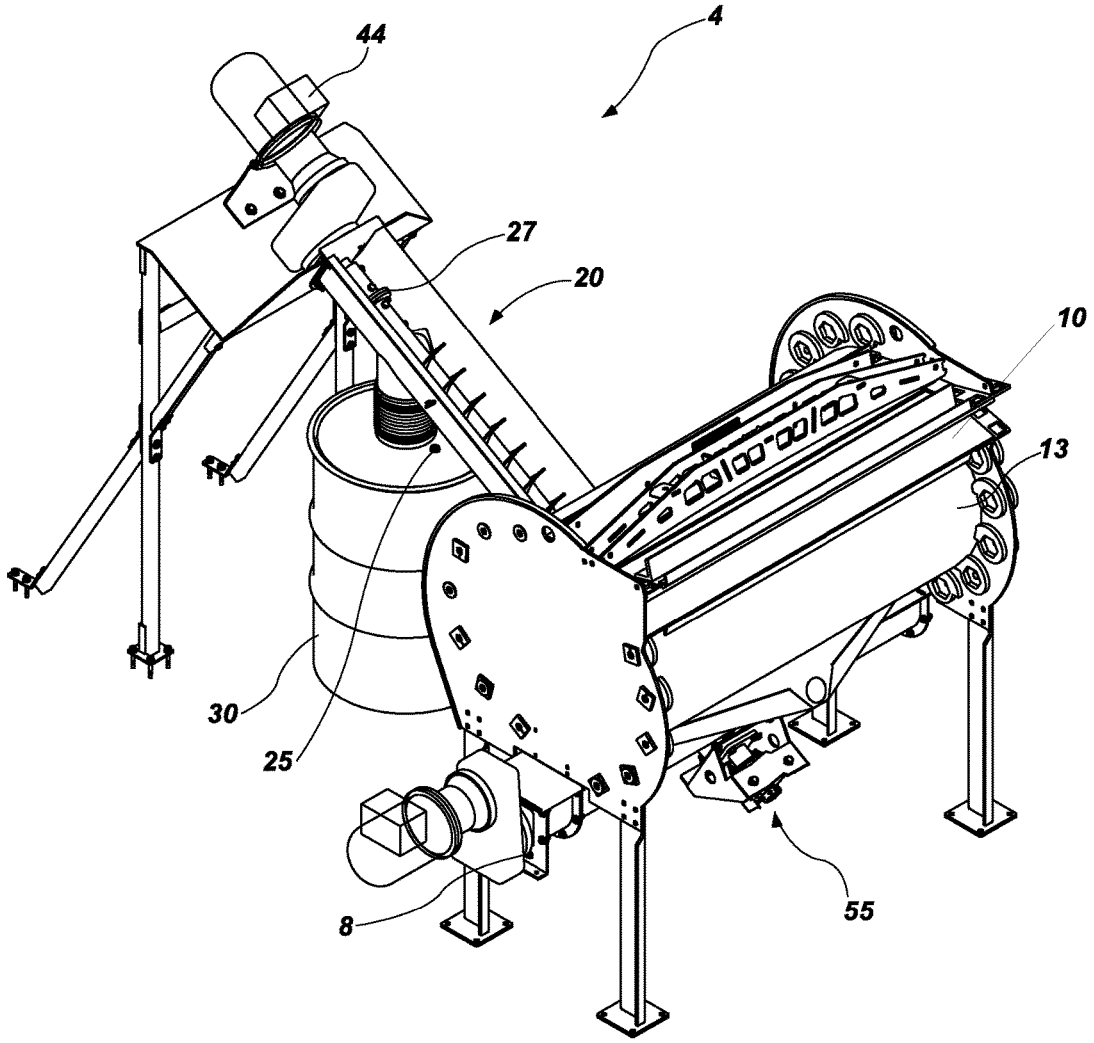
FIG. 1 shows a perspective view of a lead collection and containment system disclosed herein.

It will be appreciated that the drawings are illustrative and not limiting of the scope of the invention which is defined by the appended claims. The various elements of the invention accomplish various aspects and objects of the invention. It is appreciated that not every element of the invention can be clearly displayed in a single drawing, and as such not every drawing shows each element of the invention.

DETAILED DESCRIPTION

The drawings will now be discussed in reference to the numerals provided therein so as to enable one skilled in the art to practice the present invention. The drawings and descriptions are exemplary of various aspects of the invention and are not intended to narrow the scope of the appended claims. It will be appreciated that the various aspects of the lead collection systems discussed herein may be the same. Different reference numerals may be used to describe similar structures in the various lead collection systems for clarity purposes only.

Various aspects of the invention and accompanying drawings will now be discussed in reference to the numerals provided therein so as to enable one skilled in the art to practice the present invention. The skilled artisan will understand, however, that the methods described below can be practiced without employing these specific details, or that they can be used for purposes other than those described herein. Indeed, they can be modified and can be used in conjunction with products and techniques known to those of skill in the art in light of the present disclosure. Furthermore, it will be appreciated that the drawings may show some aspects of the invention in isolation and the elements in one figure may be used in conjunction with elements shown in other figures.

Reference in the specification to "one configuration," "one embodiment" "one aspect" or "a configuration," "an embodiment" or "an aspect" means that a particular feature, structure, or characteristic described in connection with the configuration may be included in at least one configuration and not that any particular configuration is required to have a particular feature, structure or characteristic described herein unless set forth in the claim. The appearances of the phrase "in one configuration" or similar phrases in various places in the specification are not necessarily all referring to the same configuration, and may not necessarily limit the inclusion of a particular element of the invention to a single configuration, rather the element may be included in other or all configurations discussed herein. Thus it will be appreciated that the claims are not intended to be limited by the representative configurations shown herein. Rather, the various representative configurations are simply provided to help one of ordinary skill in the art to practice the inventive concepts claimed herein.

Furthermore, the described features, structures, or characteristics of embodiments of the present disclosure may be combined in any suitable manner in one or more embodiments. In the following description, numerous specific details may be provided, such as examples of products or manufacturing techniques that may be used, to provide a thorough understanding of embodiments of the invention. One skilled in the relevant art will recognize, however, that embodiments discussed in the disclosure may be practiced without one or more of the specific details, or with other methods, components, materials, and so forth. In other instances, well-known structures, materials, or operations may not be shown or described in detail to avoid obscuring aspects of the invention.

Before the present invention is disclosed and described in detail, it should be understood that the present invention is not limited to any particular structures, process steps, or materials discussed or disclosed herein. More specifically, the invention is defined by the terms set forth in the claims. It should also be understood that terminology contained herein is used for the purpose of describing particular aspects of the invention only and is not intended to limit the invention to the aspects or embodiments shown unless expressly indicated as such. Likewise, the discussion of any particular aspect of the invention is not to be understood as a requirement that such aspect is required to be present apart from an express inclusion of that aspect in the claims.

It should also be noted that, as used in this specification and the appended claims, singular forms such as "a," "an," and "the" may include the plural unless the context clearly dictates otherwise. Thus, for example, reference to "a bracket" may include an embodiment having one or more of such brackets, and reference to "the target plate" may include reference to one or more of such target plates.

As used herein, the terms "substantially" and generally refers to the complete or nearly complete extent or degree of an action, characteristic, property, state, structure, item, or result to function as indicated. For example, an object that is "substantially" enclosed would mean that the object is either completely enclosed or nearly completely enclosed. The exact allowable degree of deviation from absolute completeness may in some cases depend on the specific context, such that enclosing the nearly all of the length of a lumen would be substantially enclosed, even if the distal end of the structure enclosing the lumen had a slit or channel formed along a portion thereof. The use of "substantially" is equally applicable when used in a negative connotation to refer to the complete or near complete lack of an action, characteristic, property, state, structure, item, or result. For example, structure which is "substantially free of" a bottom would either completely lack a bottom or so nearly completely lack a bottom that the effect would be effectively the same as if it completely lacked a bottom.

Likewise, the term generally means that something is nearly the term modified without it being exact. For example, a term that something is generally vertical would include not only something which is exactly 90 degrees from horizontal, but also angles close enough thereto that they would be considered vertical to an ordinary observers, such as greater than 80 degrees.

As used herein, the term "about" is used to provide flexibility to a numerical range endpoint by providing that a given value may be "a little above" or "a little below" the endpoint while still accomplishing the function associated with the range.

As used herein, a plurality of items, structural elements, compositional elements, and/or materials may be presented in a common list for convenience. However, these lists should be construed as though each member of the list is individually identified as a separate and unique member.

Concentrations, amounts, proportions and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually. This same principle applies to ranges reciting only one numerical value as a minimum or a maximum. Furthermore, such an interpretation should apply regardless of the breadth of the range or the characteristics being described.

The invention and accompanying drawings will now be discussed in reference to the numerals provided therein so as to enable one skilled in the art to practice the present invention. The drawings and descriptions are intended to be exemplary of various aspects of the invention and are not intended to narrow the scope of the appended claims. Furthermore, it will be appreciated that the drawings may show aspects of the invention in isolation and the elements in one figure may be used in conjunction with elements shown in other figures.

Turning to FIG. 1, there is shown a perspective view of a lead collection system generally indicated at 4. The lead collection system 4 may include a first, horizontal auger 8 which is configured to move lead passing out of the bottom of a bullet trap 13 into a discharge auger 20. The discharge auger 20 may then move lead into a lead containment barrel 30 equipped with an ultrasonic barrel fill sensor 25. One or more of the horizontal auger 8 and the discharge auger 20 may be equipped with a rotational sensor system 55 and/or a shear coupling 27, as described below.

In use, a bullet is projected through a funnel-shaped channel (not show) and into the inlet 10 of a bullet trap 13. The bullet impacts the plates forming the bullet trap until the bullet decelerates and passes out of an outlet (not shown) along the bottom of the bullet trap 13. The bullet and/or bullet fragments pass into the horizontal auger 8, which moves the bullets/fragments to a discharge auger 20. The discharge auger 20 may then move the lead to a lead containment barrel 30. The amount of lead in the discharge barrel can be determined by the ultrasonic sensor 25, in a manner discussed below.

Such systems are advantageous because they minimize the exposure of range personnel to lead and reduce the time required to dispose of the bullets and bullet fragments. Such systems, however, are also costly to install and to repair.

Figure 2:
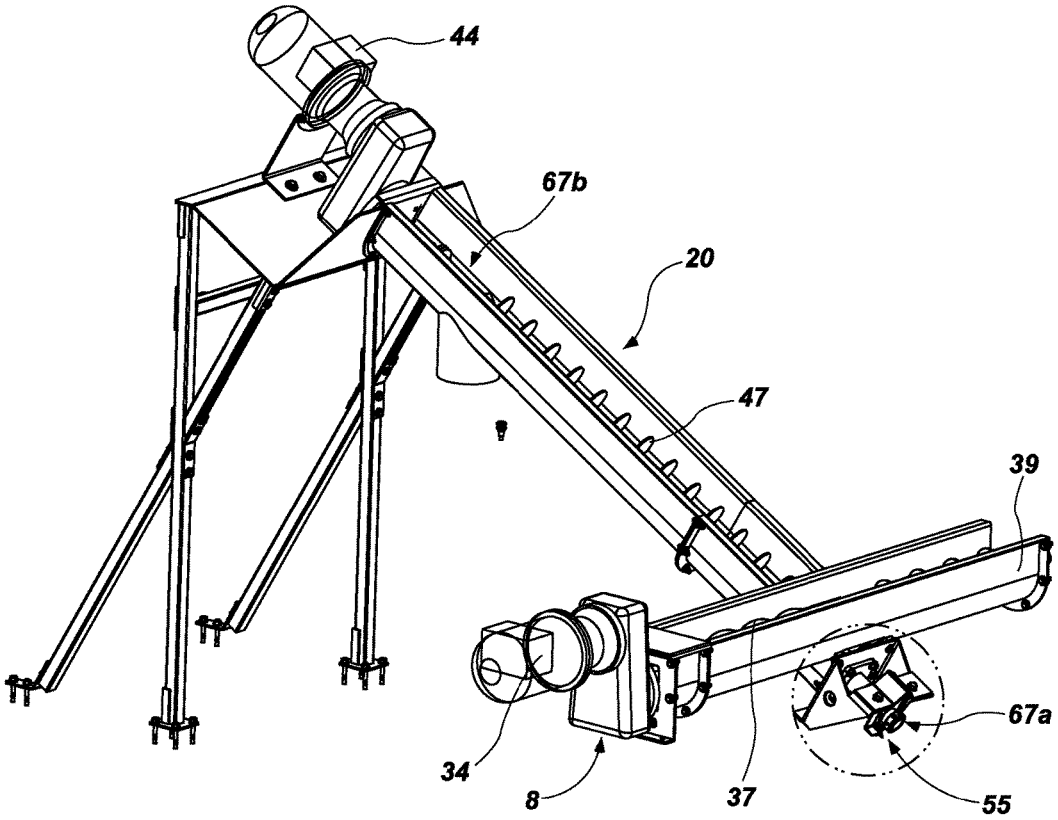
FIG. 2 shows a perspective view of the horizontal auger and lead discharge auger with a rotational sensor system as described herein.

Turning now to FIG. 2, there is shown a perspective view of the horizontal auger 8 and discharge auger 20. For clarity, no bullet trap or discharge barrel is shown. The horizontal auger 8 may be equipped with a horizontal drive motor and gearbox 34 to drive a transition screw conveyor 37 in a transition trough 39 to move lead and any associated material passing out of the bullet trap toward the discharge auger 20. Thus, for example, the screw conveyor may have opposing flights or blades so that rotation of the screw conveyor in one direction drives bullet fragments toward the discharge auger regardless of which side of the discharge auger engagement they commence on.

Figure 3:
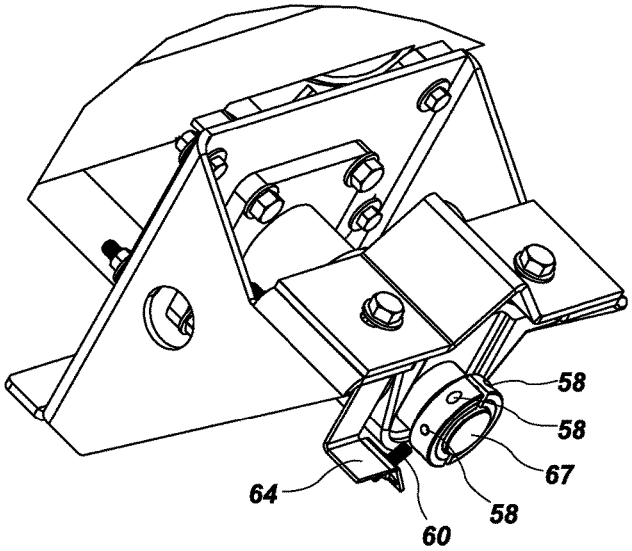
FIG. 3 shows a blown-up partial view of the rotational sensor system of FIG. 2.

Similarly, the discharge auger 20 may be equipped with a discharge drive motor and gearbox 44 to drive a discharge screw conveyor 47 in a discharge trough or conduit 49 to move lead toward a lead containment barrel (barrel not shown in FIG. 2). (While shown as being open for visibility, the conduit 49 will typically enclose the discharge auger 20 to minimize lead dust in the atmosphere), Because augers and drive motors may be expensive and difficult to replace, it may be desirable to provide systems to ensure that the augers are working correctly and provide automated shut-offs and the like when it is detected that an auger is not working correctly. According to one aspect of the present invention, an auger may be equipped with a rotational sensor system 55 to detect the rotational or angular speed of an auger. The rotational sensor system 55 may be comprised of a substrate 58, or a material to be sensed, and a sensor 60 as shown in FIG. 3. As the shaft of the auger turns, the sensor 60 detects the movement of the substrates or material being sensed to thereby provide an indication of the speed.

The rotational sensor system 55 may communicate with a processor, such as a computer, that compares the actual, detected rotational speed with the theoretical programmed or commanded speed in order to make a decision about the state of the auger shaft. When the system detects that the two speeds are different or have a difference greater than a predetermined threshold, it may shut off the lead collection system to prevent damage to the auger or other associated parts. For example, if the actual measured shaft rotation speed is higher than the commanded speed, there may be an error in the system and the system may shut off the drive motor that powers the auger for inspection. Similarly, if the shaft is rotating at a slower than expected speed, it likely indicates that the auger is encountering a larger than expected load, such as may occur when lead fragments have built up and are impeding rotation of the auger, and this may cause an error in the system and the system may shut off the drive motor that powers the auger. The system may also include an allowable error range to account for signal uncertainty. If the auger were allowed to continue to run overloaded, it is possible that the auger shaft or the vane surrounding the shaft would break. Such a breakage not only is expensive, it also usually requires that the range be down at least during repairs and sometimes while parts are ordered to repair the auger.

Figure 4:
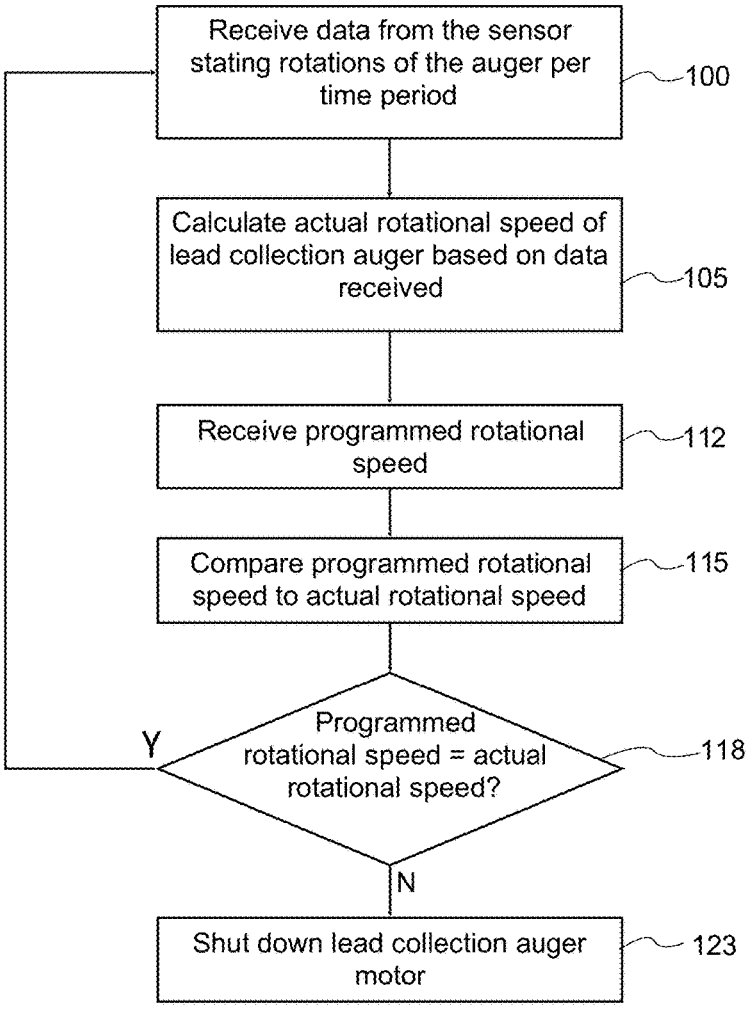
FIG. 4 shows possible logic of a processor of the rotational sensor system.
Figure 5:
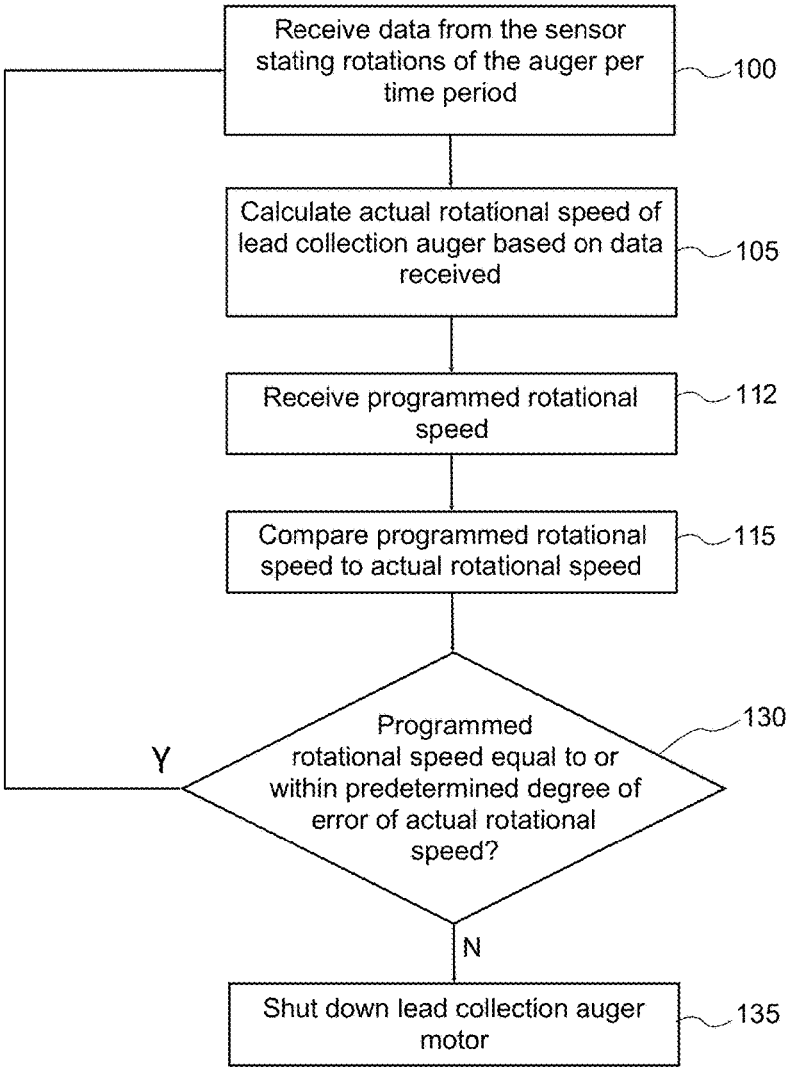
FIG. 5 shows another possible logic of a processor of the rotational sensor system.

Turning now to FIGS. 4 and 5, there is shown an outline of logic that a processor may use to shut off the drive motor. It will be appreciated that while the logic in FIGS. 4 and 5 is shown in a particular order for purposes of explanation, the order may be changed and still accomplish the same end. Similarly, while the logic is shown as discrete steps, more than one step may be taken at a time and multiple steps may be performed at once. The processor may first receive data from the sensor 60 indicating how many rotations of the auger shaft the sensor detected in a given time period (100). Based on the data received from the sensor 60, the processor may then calculate the actual rotational speed of the auger (105). The processor may receive a programmed rotational speed (112), or the programmed rotational speed may have already been received by the processor.

The processor may then compare the programmed rotational speed to the actual rotational speed (115). If the programmed rotational speed is equal to the actual rotational speed 118, the system may begin the query again and continue the loop to check the actual rotational speed against the programmed rotational speed. If, however, the actual rotational speed and the programmed rotational speed are not equal, the processor may send a signal to shut down the motor that powers the auger 123.

FIG. 5 shows similar logic to FIG. 4, except with the processor taking into account a predetermined degree of error (130). Depending on the desired operation of the system, it may not be required for the actual rotational speed and the programmed rotational speed to be exactly the same for acceptable operation. A user may thus program a predetermined degree of error into the system which the user will allow for without the system shutting down the auger motor. The processor may thus determine if the actual rotational speed is equal to, or within the predetermined degree of error to the actual rotational speed (130). Where the actual rotational speed is equal to or within the predetermined degree of error, the logic may continue again and compare the speeds. The loop may be performed, for example, multiple times per second to multiple times per minute, depending on the speed of the auger. Where the actual rotational speed is not equal to nor within the predetermined degree of error, the logic may send a signal to shut down the lead collection auger motor (135).

For example, if a user programs an auger to rotate at a speed y, and there is a blockage such that the auger rotates at a lower speed x, the system may detect an error and may automatically shut off to prevent any breakage or other equipment failures. The system may further indicate that there is likely an obstruction which is interfering with the rotation of the auger.

The sensor 60 and the substrate 58 may be any suitable combination known in the art, and all are contemplated herein. The following sensor/substrate combinations, by way example and not of limitation, may be used: an inductive sensor with a steel substrate, a magnetic substrate with a hall effect sensor, a reflective substrate with a light detecting sensor, a radio-frequency identification (RFID) detecting sensor with a RFID substrate, etc. The sensor/substrate combination may be chosen depending on the setting.

In some configurations, where the substrate may be subject to exposure and become coated or otherwise covered, either partially or entirely, a magnetic substrate with a Hall Effect sensor may be used. A Hall Effect sensor may detect the magnetic substrate even if it has been covered or coated with another material, such as buildup that may occur over time.

Typically, the sensor 60 is mounted on a stationary location, such as sensor bracket 64, and the substrate 58 is mounted to the rotating shaft 67 of the discharge auger 20. A single substrate 58 may be used, or multiple substrates 58 may be used. However, a sensor which travels on the auger may also be used with stationary substrates.

According to the configuration shown in FIG. 3, multiple substrates 58 may be used that are spaced equidistance apart on the shaft 67. Depending on the desired resolution, more substrates may be used on the shaft diameter, as increasing the number of substrates tends to improve the resolution for speed measurement.

Placement of the sensor 60 and substrate 58 along the shaft 67 may also vary depending on the setting and the needs. The sensor 60 and substrate 58 may typically be placed at any point along the shaft 67. In same configurations, the shaft 67 may have a first end 67*a* and a second end 67*b*, with the first end 67*a* extending below of the transition trough 39, and the second end 67*b* connected to the discharge drive motor and gearbox 44. If a user desires to monitor the entire length or nearly the entire length of shaft 67, the substrate 58 and sensor 60 may be placed at the first end 67*a* of the shaft 67, opposite the second end 67*b* connected to the discharge drive motor and gearbox 44. In this manner, the sensor 60 monitors the entire length, or nearly the entire length, of the shaft 67. The substrate 58 and sensor 60 may be placed at a different point on the shaft 67 if desired.

The rotational sensor 60 and substrate 58 may thus be used to measure the actual speed of the auger shaft 67. The sensor 60 may communicate either wirelessly or otherwise, to a system that compares the actual speed of the auger shaft 67 to the commanded or inputted speed. The system may be programmed to cause an error and shut down the discharge drive motor and gearbox 44 if there is any difference between the actual speed and the commanded speed. The system may have an allowable degree of error programmed to calculate for signal uncertainty. Similarly, the horizontal auger 8 may also have a rotational sensor and substrate to measure the actual speed of the horizontal auger 8 and compare it to a programmed speed. An automatic shut off may work to prevent any mechanical damage to the augers, as the augers may bind and break if the driving motor continues to apply torque when sufficient resistance is being applied to the flights of the auger.

The rotational sensors may be programmed to change their level of sensitivity, acceptable level of error, etc. Depending on the setting, fewer or more substrates may be used as well. Programming of the rotational sensor precisely may allow the system to quickly detect when the shaft has stopped spinning and shut down before there is equipment damage, but also avoid false readings that would shut down the system needlessly.

Figure 6:
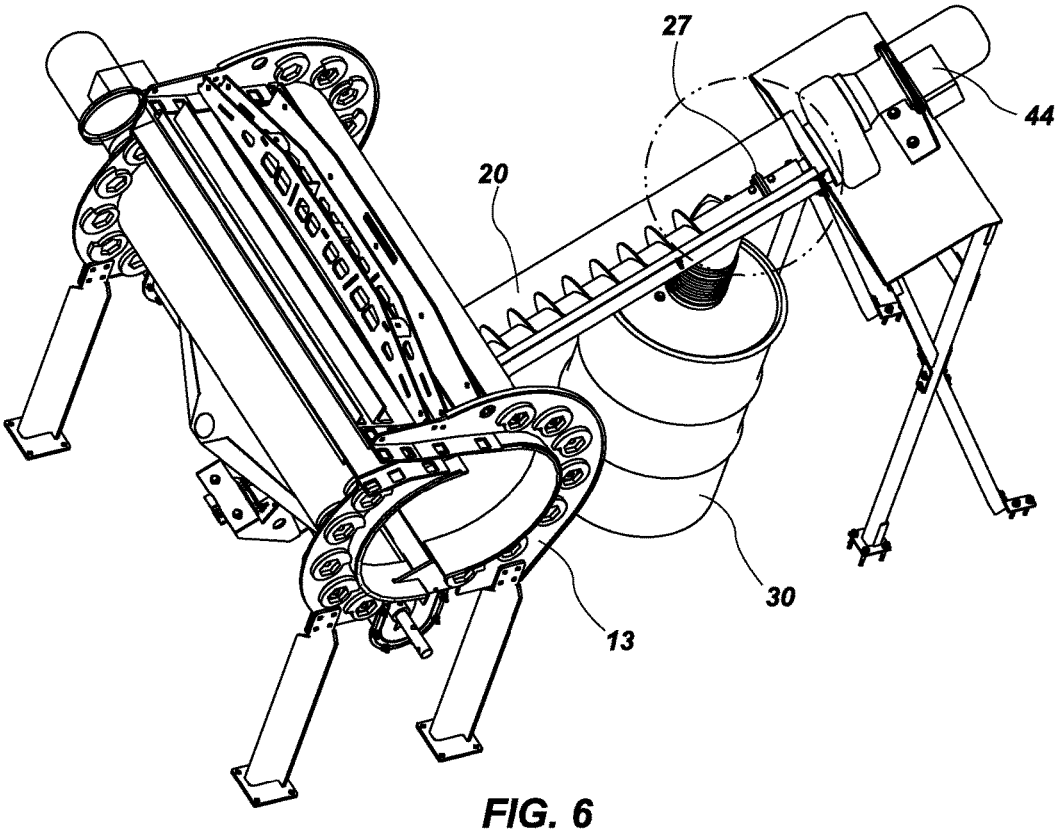
FIG. 6 shows a perspective view of the lead collection system described herein with a shear coupling.
Figure 7:
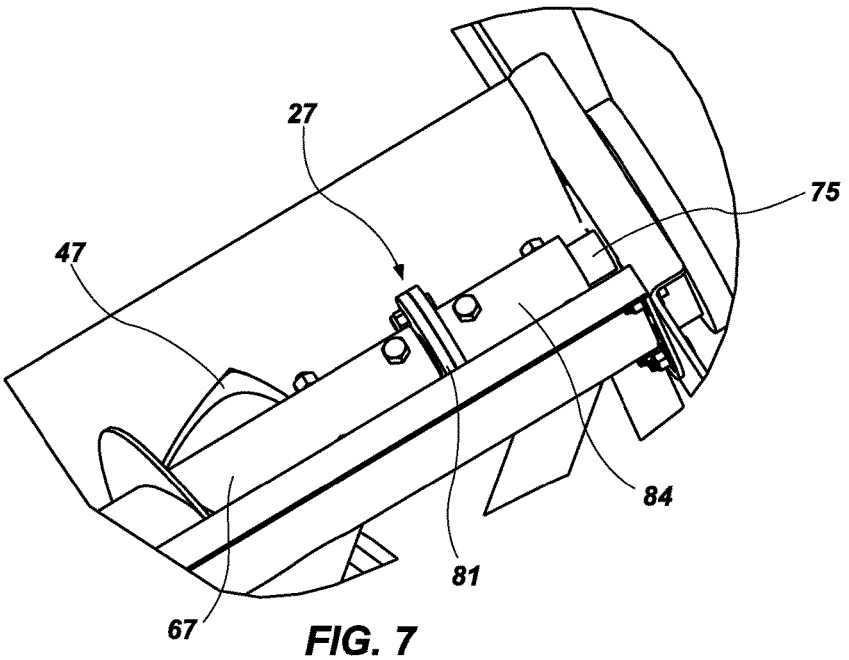
FIGS. 7 and 8 show close-up fragmented views of the shear coupling of FIG. 6.

The augers may also be equipped with another level of protection by the use of a shear coupling 27. Turning now to FIG. 6, there is show a top perspective view of the lead collection system 4. The discharge auger 20 may be provided with a shear coupling 27. As seen in FIG. 7, the shear coupling 27 may couple the shaft 67 of the screw conveyor 47 to the drive shaft 75 of the discharge drive motor 44. The shear coupling 27 is designed to break before any other component in the system breaks. Thus, if sufficient torque is applied, components of the shear coupling 27 may break first, and the discharge drive motor 44 may no longer apply torque to the shaft 67 of the screw conveyor 47.

Figure 8:
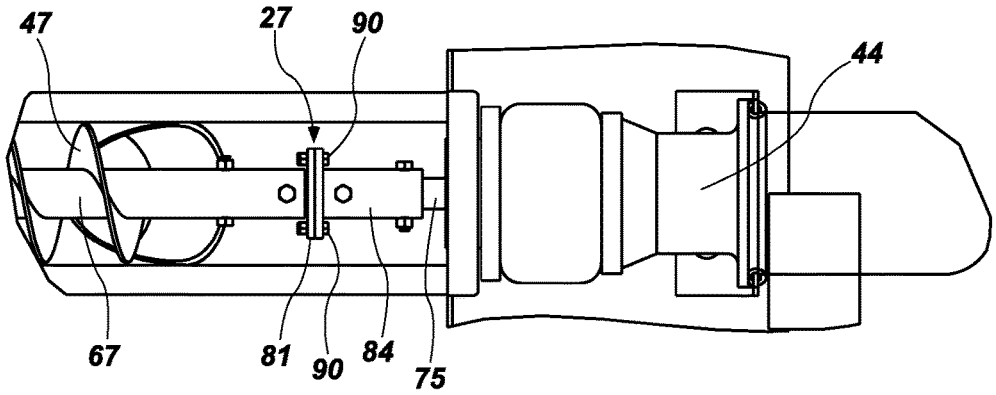

FIG. 7 shows a detailed view of the shear coupling shown in FIG. 6. The drive motor shaft 75 is connected to a portion of the shear coupling 27 by any suitable means, such as by providing screws that pass through a second adapter 84 of the shear coupling 27 and engage the drive motor shaft 75. Similarly, the screw conveyor 47 is connected by any suitable means to a first adapter 81 which forms another portion of the shear coupling 27. FIG. 8 shows a top view of the drive motor 44 and shear coupling 27, along with the first and second adapters 81 and 84.

Figure 9:
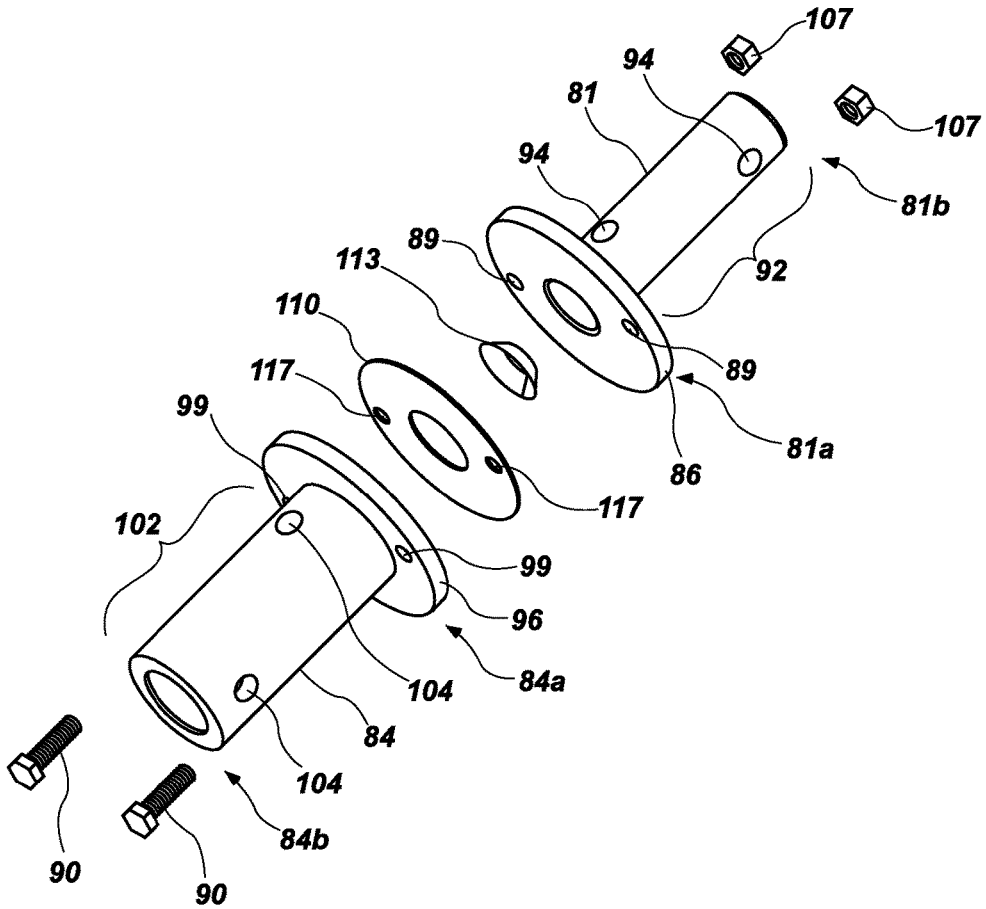
FIG. 9 shows an exploded view of a shear coupling as described herein.

Turning now to FIG. 9, there is shown an exploded view of the shear coupling 27. The shear coupling may include the first adapter 81 and second adapter 84. The first adapter 81 may have a first end generally indicated at 81*a* and a second end generally indicated at 81b. The first end 81*a* may include a flange 86 that extends radially outward. The flange 86 may be formed integrally to the first adapter 81 or may be connected thereto. The flange 86 may have one or more holes 89 therethrough, the holes being sized to receive one or more shear bolts 90. The first adapter 81 may include a section or portion that is shaped generally as a cylinder 92. The cylindrical portion 92 may be hollow and sized to receive the shaft 67 of the discharge screw conveyor 47. Alternatively, the cylindrical portion may be sized to fit within the shaft 67 of the discharge screw conveyor 47. Any suitable connection means may be used. The cylindrical portion 92 may also be provided with additional means to connect the first adapter 81 to the shaft 67, such as holes 94 for a screw to pass through.

The second adapter 84 may have a first end 84*a* and a second end 81*b*, The first end 81*a* may include a flange 96 that extends radially outward. The flange 96 may be formed integrally to the second adapter 84 or may be connected thereto. The flange 96 may have one or more holes 99 therethrough, the holes being sized to receive one or more shear bolts 90. The second adapter 84 may include a section or portion that is shaped generally as a hollow cylinder 102. The hollow cylindrical portion 102 may be sized to receive the motor shaft 75. The hollow cylindrical portion 102 may also be provided with additional means to connect the second adapter 84 to the motor shaft 75, such as holes 104 for a screw to pass through.

One or more shear bolts 90 may be provided, and in connecting the shear coupling, the shear bolts 90 may pass first through the holes 99 in the flange 96 of the second adapter 84, then through the holes 89 of the flange 86 of the first adapter 81. Nuts 107 may then be secured to the shear bolts 90 to hold them in place. In some configurations, one or more bushings may be provided between the flange 86 of the first adapter and the flange 96 of the second adapter. As shown in FIG. 9, a flat bushing 110 and/or a cone bushing 113 may be provided. Depending on the diameter of the bushing, the bushing may be provided with holes therethrough such that the shear bolt may pass through the bushing.

Figure 10:
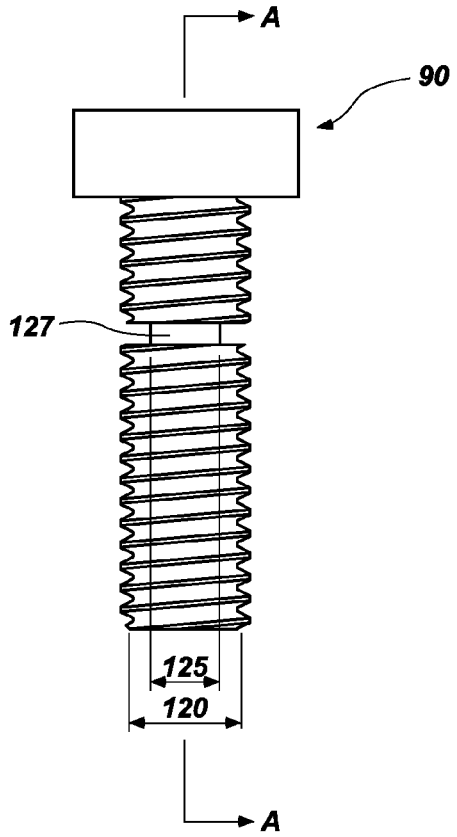
FIG. 10 shows a side view of a shear bolt.
Figure 11:
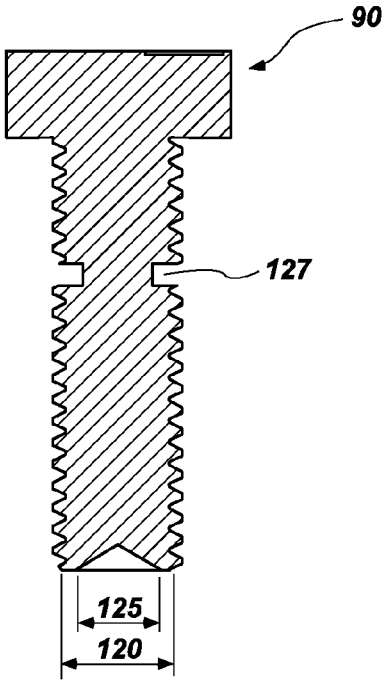
FIG. 11 shows a side cross-sectional view of a shear bolt taken along line A-A of FIG. 10.

Turning now to FIG. 10, there is shown a side view of a shear bolt 90. The shear bolt may have a nominal diameter 120 and a smaller shearing plane diameter 125. The shearing plane diameter 125 may be formed from a groove 127 in the shear bolt 90. The shearing plane diameter may be selected such that stress in the bolt in the shearing plane reaches the ultimate shear strength of the bolt material at a predetermined torque. Thus, when the predetermined torque (i.e. a torque above that desired for normal operation of the auger) is applied, the shear bolt 90 may shear at the groove 127. FIG. 11 shows a cross-sectional view taken along line A-A of FIG. 10. The diameter of the shearing plane may be calculated based on the materials used and the desired torque at which the bolts should shear. For example, sizing of the shear plane bolt diameters using the following equation:

$$d = \sqrt{\frac{4\tau}{\pi\tau_b D}}$$

Where d is the diameter of each bolt in the shearing plane; D is the nominal diameter of the bolt; $\tau$ is the torque applied to the system; and $\tau_b$ is the shear strength of the material.

The shear strength may be approximated as 0.577 of the tensile strength. Thus, the stress felt in each bolt at the shearing point may be approximated as 0.577 times tensile strength. If shear strength $\tau_b$ is 0.577 $Su\tau_b$, the equation may be written as follows:

$$d = \sqrt{\frac{4\tau}{\pi(0.577\ Su\tau_b)D}}$$

To ensure that the bolts shear before other components in the system, the failure thresholds of other components (such as bearing in the bolts, bearing in the flange, tear out in the flange, etc.) may be calculated and compared.

Figure 12:
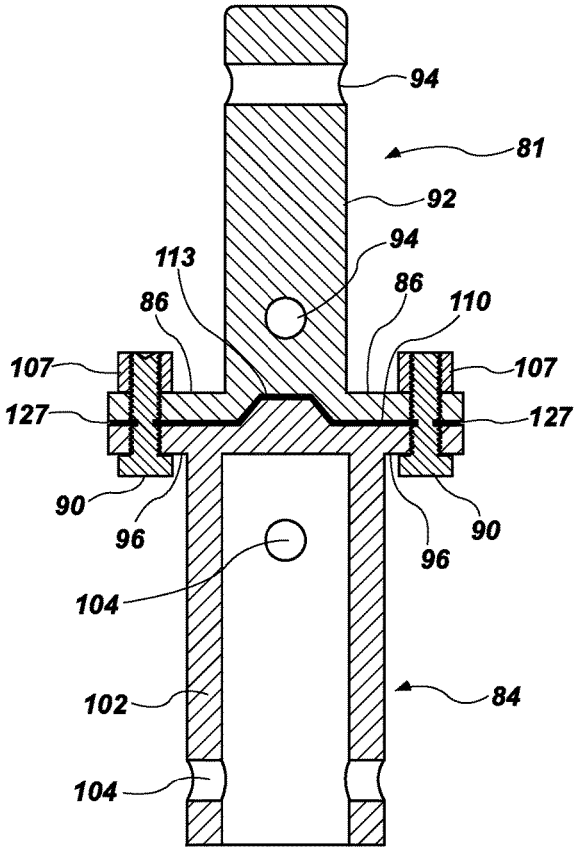
FIG. 12 shows a top, sectional view of a shear coupling.

Turning now to FIG. 12, there is shown a cross sectional view of a shear coupling (shafts to be connected to the shear coupling are omitted for clarity). When installed, the shearing plane defined by groove 127 may be aligned with the faces of the mating flanges 86 and 96. To ensure proper placement of the shearing plane, the length of the shearing bolt 90 between the head and the shearing plane defined by groove 127 may be around the same length as the thickness of flanges 86, 96. Thus, when installed, the shearing plane at groove 127 may align with the mating flanges 86, 96. When the shear bolt 90 shears at groove 127, it may allow the motor drive shaft 75 and the screw conveyor shaft 67 to spin independently. With the two shafts spinning independently, one or more bushings, such as flat bushing 110 and cone bushing 113 may provide an interface between the two flanges and dampen the energy transmitted through the bushing(s). The bushings may help prevent or minimize damage to the adapter flange surfaces.

The use of flanges on each of the first adapter 81 and second adapter 84 may allow for a single shearing plane in the shear bolt 90. This may prevent any components of the shear bolt from becoming captive and thus continuing to transmit torque above the desired shearing torque. A single shearing plane may also allow for a greater degree of control and precision in calculating the torque necessary to shear the bolt. Thus, in the event bullets/fragments build up or some other debris gets into the trough or conduit around the auger and engages the auger sufficiently, the shear bolts 90 will give before the flights or shaft of the auger, thereby preventing damage to the parts of the system which are more expensive and harder to replace.

Another control feature of the lead collection system described herein may be a containment barrel with a sensor. If a container of lead under an auger gets overfilled, the bullets/fragments can start to be compacted into an ingot. Eventually the overfill will engage the flights or vanes of the auger and may damage the auger. Additionally, an overfilled barrel creates cleanup concerns as lead may spill onto the ground when the barrel is being replaced.

Figure 13:
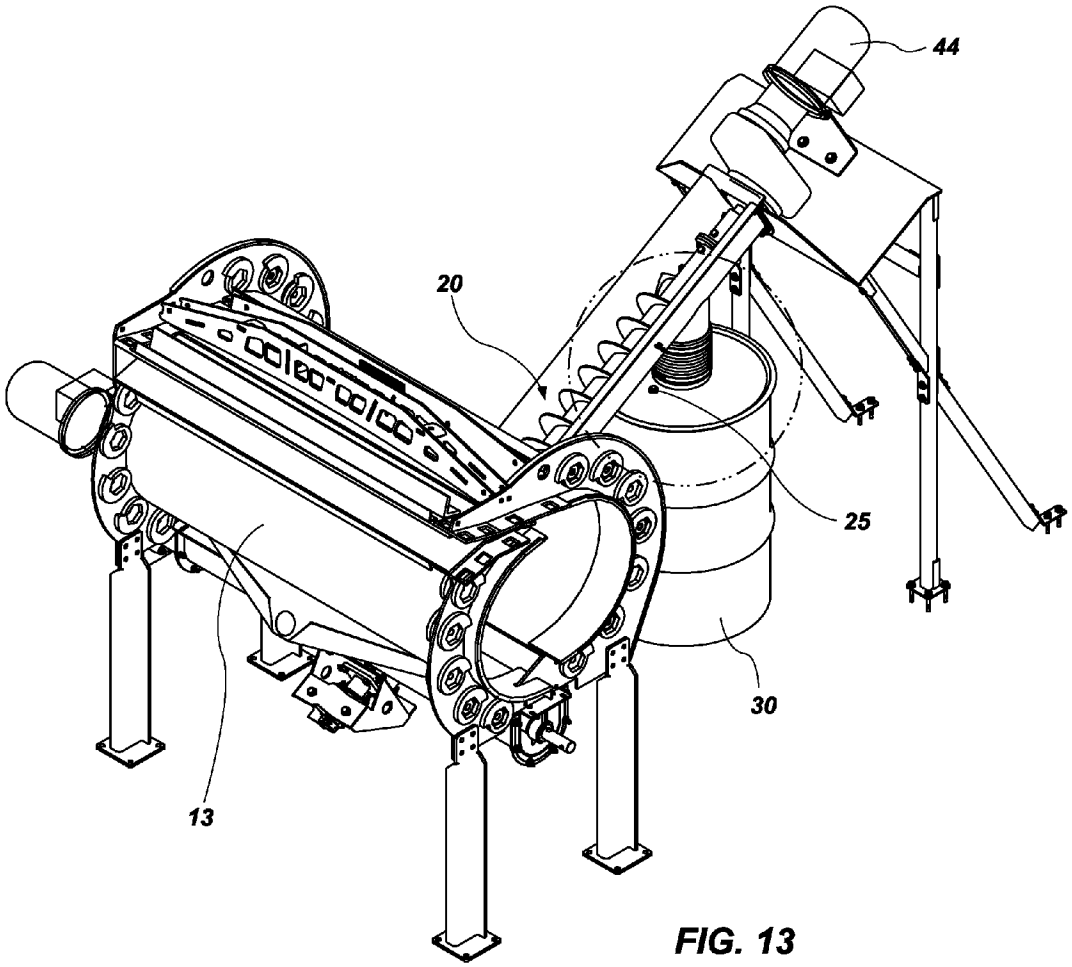
FIG. 13 shows a top perspective view of the lead collection system and containment barrel disclosed herein.

The screw conveyors of the horizontal auger 8 and the discharge auger 20 may work together to bring lead from a bullet trap 13 into a lead containment barrel 30, as shown in FIG. 13. The lead containment barrel 30 may be filled with lead from the bullet trap and thus safely contain the lead until the barrel is full. However, it may be difficult to determine when the barrel is full, and if the barrel is over-filled, it can result in hazardous conditions and damage to equipment.

Figure 14:
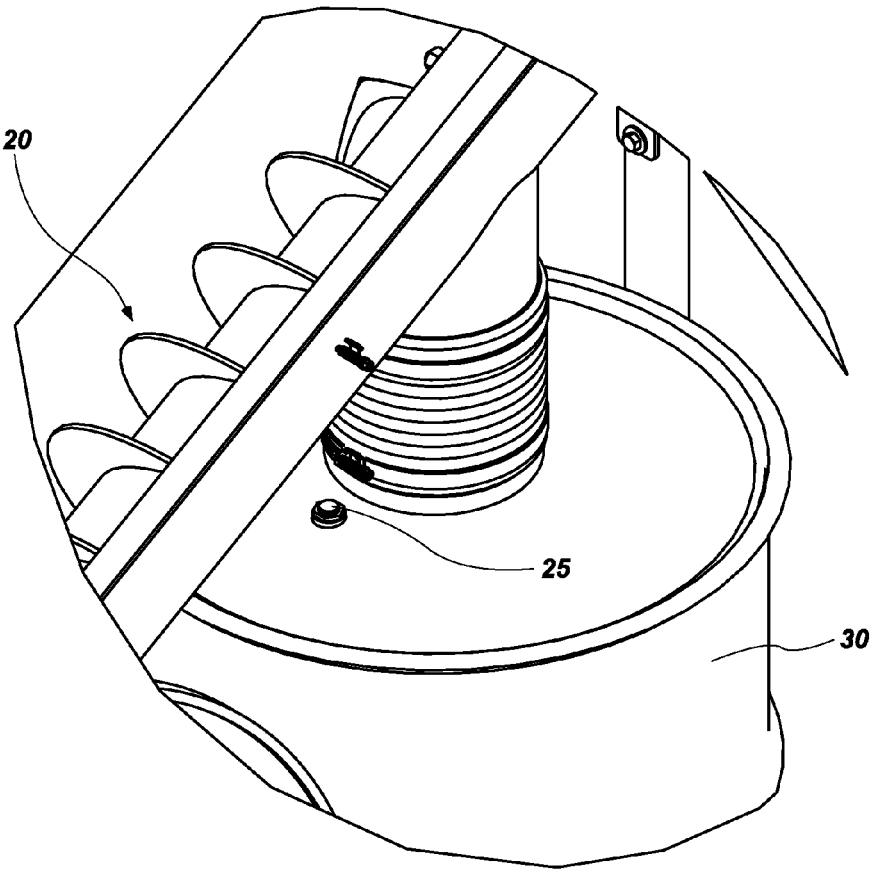
FIG. 14 shows a close-up, partial view of the containment barrel of FIG. 13.

A containment barrel 30 may be provided with an ultrasonic sensor 25, as shown in FIG. 14. One problem with sensing the contents of the barrel is that the bullets and fragments are often transported with substantial lead dust. The lead dust interferes with the ability of many sensors to determine when the barrel is full or in need of emptying. It has been found, however, that an ultrasonic sensor can sufficiently determine the level of lead in the barrel despite the presence of the lead dust without the need for regular cleaning, especially in the dirty environment of a lead collection barrel. The ultrasonic sensor 25 may be active or passive. In one configuration, the ultrasonic sensor 25 (such as a piezoelectric transducer or similar sensor) may generate high-frequency sound waves and evaluate the echo which is received back by the sensor, measuring the time interval between sending the signal and receiving the echo to determine the distance to an object, such as lead build-up in a barrel. This information may be communicated from the sensor to a computer or processor by any suitable means of communication, for example, readings may be electrically communicated by means of an analog current (4-20 mA standard). Any suitable digital or analog voltage or current may work.

Figure 15:
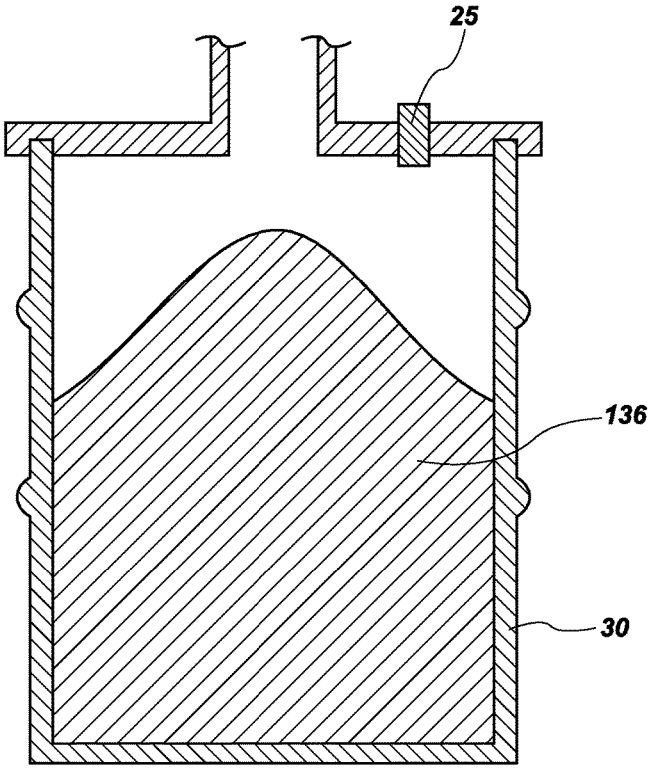
FIG. 15 shows a side, sectional view of a containment barrel with lead collected therein.

The ultrasonic sensor 25 may be placed at various locations, and in one configuration, the ultrasonic sensor may be placed at the top of the barrel, as shown in FIG. 14. However, the top of the lead 136 as it is collected in the barrel may have a conical shape, see FIG. 15. Thus, depending on the placement of the sensor 25, it may be necessary to program parameters that account for the conical shape of the collected lead such that the barrel does not become too full. In the alternative, an ultrasonic emitter could be placed on one side of the barrel and an ultrasonic receiver placed on the opposing side. When an emitted signal from the emitter is no longer received by the receiver, a signal may be generated that it is time to empty or replace the barrel.

While the various aspects of the invention are discussed with respect to individual embodiments, it will be appreciated that various aspects of one embodiment may be used with other embodiments and have been omitted for brevity.

It will be appreciated that the present disclosure includes multiple inventions and aspects thereof, each of which may be independently patentable.

Described herein is a shear coupling to couple a motor drive shaft to a screw conveyor shaft, the shear coupling comprising: a first adapter, the first adapter having a cylindrical portion with a first end and a second end, the first end comprising a flange extending radially outwardly therefrom, the flange defining one or more holes therethrough to receive a shear bolt; and a second adapter, the second adapter having a cylindrical portion with a first end and a second end, the first end comprising a flange extending radically outwardly therefrom, the flange defining one or more holes therethrough to receive the shear bolt.

The shear coupling may further comprise a shear bolt, the shear bolt having a nominal diameter with a groove therein defining a shearing plane diameter. It may comprise a bushing placed between the flange of the first adapter and the flange of he second adapter. The bushing may be a cone bushing, a flat bushing, or both.

In some configurations, the cylindrical portion of the first adapter defines one or more holes for connection to a shaft. The cylindrical portion of the second adapter may define one or more holes for connection to a shaft. At least one of the cylindrical portion of the second adapter and first adapter comprises a hollow cylinder.

According to another configuration, a projectile transport system for a bullet trap is described, comprising: A bullet trap having an inlet for receiving projectiles and an outlet for projectiles passing out of the trap; an auger system disposed in communication with the bullet trap, the auger system having an auger including a shaft and a motor unit having a shaft and a shear coupling connecting the shaft of the auger to the shaft of the motor unit, the shear coupling comprising: a first adapter, the first adapter having a flange extending radially outwardly therefrom, the flange defining one or more holes therethrough to receive a shear bolt; and a second adapter, the second adapter having a flange extending radially outwardly therefrom, the flange defining one or more holes therethrough to receive the shear bolt.

The first adapter may comprise a cylindrical portion to receive a shaft, and the second adapter may comprise a cylindrical portion to receive a shaft. The system ay include a shear bolt, the shear bolt having a groove thereon defining a shearing plane. The flange of the first adapter has a thickness, and a length of the shear bolt from a head of the shear bolt to the groove may be approximately the same as the thickness of the flange of the first adapter. The first adapter defines one or more holes to connect the first adapter to a shaft, and the second adapter comprises one or more holes to connect the second adapter to a shaft. The shear coupling may also include a bushing.

Described herein is also a method of shear coupling two or more shafts, the method comprising: selecting a shear coupling, the shear coupling comprising a first adapter, the first adapter having a flange extending radially outwardly therefrom, the flange defining one or more holes therethrough to receive a shear bolt; and a second adapter, the second adapter having a flange extending radially outwardly therefrom, the flange defining one or more holes therethrough to receive the shear bolt; connecting the first adapter to a first shaft; connecting the second adapter to a second shaft; inserting one or more shear bolts through the one or more holes on the flange of the first adapter and through the one or more holes on the flange of the second adapter; and securing the one or more shear bolts with one or more nuts. The method may further include the step of placing a bushing between the flange of the first adapter and the flange of the second adapter.

Described herein is a projectile transport system comprising: a bullet trap having a containment chamber with an inlet and an outlet; an auger system disposed in communication with the bullet trap, the auger system comprising a plurality of shafts connected together by a shear coupling, at least one of the shafts forming an auger, and a sensing system for determining the speed at which at least one of the shafts rotates.

The system may include a barrel disposed in communication with the auger system, the barrel comprising a level sensor for determining the amount of projectiles in the barrel. The level sensor comprises an ultrasonic sensor. The system may further comprise a processor disposed in communication with the sensing system for determining the speed at which at least one of the shafts rotates and the level sensor, the processor being programmed to turn off the auger system when either the level sensor indicates that the barrel has passed a predetermined threshold or the rotational speed of the auger is outside a predetermined parameter.

Also described herein is a system for detecting the rotational speed of a projectile collection auger, the system comprising: an auger shaft, the auger shaft having a material to be sensed located thereon; and a sensor configured to sense the material to be sensed, the sensor placed proximally to the material to be sensed, wherein the auger shaft has a first end and a second end, and wherein the sensor and the material to be sensed are located on the first end and a motor is located on the second end. The sensor may be a hall effects sensor and the material comprises a magnetic component. The auger shaft may be connected to a screw conveyor.

The system may further comprise a processor, the processor programmed to receive the rotational speed of the lead collection discharge auger and to receive a programmed rotational speed, and wherein the processor is further programmed to compare the rotational speed to the programmed rotational speed and shut down the lead collection auger when the rotational speed and the programmed rotational speed are not the same. In some configurations, the processor is further programmed to allow a degree of error such that the lead collection auger is shut down when the rotational speed and the programmed rotational speed are not within the degree of error Also described herein is a system for detecting the rotational speed of a projectile collection auger, the system comprising: an auger shaft, the auger shaft having a sensor configured to sense a material; the material to be sensed placed proximally to the sensor configured to sense the material, wherein the auger shaft has a first end and a second end, and wherein the sensor and the material to be sensed are located on the first end and a motor is located on the second end.

Additionally, a system is disclosed herein for detecting the level of projectiles collected in a projectile collection barrel in an auger projectile collection system, the system comprising an ultrasonic sensor placed in communication with an interior of the barrel, and a processor in communication with the ultrasonic sensor, the processor programmed to receive one or more signals from the ultrasonic sensor indicating the level of projectiles within the collection barrel, and wherein the processor is further programmed shut down the auger projectile collection system when the processor receives a signal from the ultrasonic sensor indicating the level of projectiles within the collection barrel are above a predetermined threshold.

There is thus disclosed a lead collection system and method of using the same. It will be appreciated that numerous modifications may be made without departing from the scope and spirit of this disclosure. The appended claims are intended to cover such modifications.

What is claimed is:

1. A projectile transport system for a bullet trap comprising:

a bullet trap having an inlet for receiving projectiles and an outlet for projectiles passing out of the trap, the outlet being disposed adjacent a bottom portion of the bullet trap;

an auger system comprising a discharge screw conveyor disposed in communication with the outlet of the bullet trap, the discharge screw conveyor including a elongate shaft having a first end disposed lower than the outlet of the bullet trap, and a second end disposed higher than the first end, such that the elongate shaft extends upwardly at an angle between horizontal and vertical, and a flighting extending along the elongate shaft from the first end to a position proximal the second end, the auger system further comprising a housing having a rounded bottom, the housing having a housing first end disposed proximal to the first end of the elongate shaft of the discharge screw conveyor, and a housing second end adjacent the second end of the elongate shaft of the discharge screw conveyor, and wherein the housing further comprises an opening in the housing second end for discharging material moved in the housing by the discharge screw conveyor;

and the auger system further comprising a motor unit having a shaft and a shear coupling connecting the elongate shaft of the auger system to the shaft of the motor unit, the shear coupling comprising:

a first shear bolt and a second shear bolt, wherein each of the first shear bolt and the second shear bolt comprise a groove thereon defining a shearing plane;

a first adapter, the first adapter having a flange extending radially equally outwardly therefrom, the flange defining a first hole and a second hole therethrough to receive the first shear bolt and the second shear bolt, respectively; and a second adapter, the second adapter having a flange extending radially equally outwardly therefrom, the flange defining a first hole and a second hole therethrough to receive the first shear bolt and the second shear bolt, respectively.

2. The projectile transport system of claim 1, wherein the first adapter comprises a cylindrical portion to receive a shaft.

3. The projectile transport system of claim 1, wherein the second adapter comprises a cylindrical portion to receive a shaft.

4. The projectile transport system of claim 3 wherein the flange of the first adapter has a thickness, and wherein a length of the first shear bolt from a head of the first shear bolt to the groove is approximately the same as the thickness of the flange of the first adapter.

5. The projectile transport system of claim 2, wherein the first adapter defines one or more holes to connect the first adapter to a shaft.

6. The projectile transport system of claim 3, wherein the second adapter comprises one or more holes to connect the second adapter to a shaft.

7. The projectile transport system of claim 1, further comprising a bushing.

8. The shear coupling of claim 6, wherein the shaft of the motor and the elongate shaft of the auger system each have an inner diameter and an outer diameter, and wherein the first adapter is coupled to the inner diameter of one of the motor shaft and elongate shaft of the auger system, and wherein the second adapter is coupled to the outer diameter of the other of the motor auger and the elongate shaft.

9. The shear coupling of claim 6, wherein the first adapter and the second adapter are coupled to the motor shaft and the elongate shaft in-line.

10. The projectile transport system of claim 1, wherein the auger system comprises a first auger system, and further comprising a second auger system disposed in communication with the outlet of the bullet trap, the second auger system comprising a horizontal auger having a horizontal shaft, the horizontal auger comprising a horizontal screw conveyor and a housing extending between a first end and a second end, wherein the housing comprises an opening in the housing between the first end and the second end for discharging material moved in the housing by the horizontal screw conveyor, and wherein the opening is disposed adjacent the first end of the elongate shaft of the discharge screw conveyor of the first auger system.

11. The projectile transport system of claim 10, further comprising a sensing system for determining the speed at which at least one of the horizontal shaft and the elongate shaft rotates.

12. A system for detecting the rotational speed of a projectile collection auger, the system comprising:

a projectile transport system for a bullet trap comprising:

a bullet trap having an inlet for receiving projectiles and an outlet for projectiles passing out of the trap, the outlet being disposed adjacent a bottom portion of the bullet trap;

an auger system comprising a discharge screw conveyor disposed in communication with the outlet of the bullet trap, the discharge screw conveyor including a elongate shaft having a first end disposed lower than the outlet of the bullet trap, and a second end disposed higher than the first end, such that the elongate shaft extends upwardly at an angle between horizontal and vertical, and a flighting extending along the elongate shaft from the first end to a position proximal the second end, the auger system further comprising a housing having a rounded bottom, the housing having a housing first end disposed proximal to the first end of the elongate shaft of the discharge screw conveyor, and a housing second end adjacent the second end of the elongate shaft of the discharge screw conveyor, and wherein the housing further comprises an opening in the housing second end for discharging material moved in the housing by the discharge screw conveyor;

and the auger system further comprising a motor unit having a shaft and a shear coupling connecting the elongate shaft of the auger system to the shaft of the motor unit, the shear coupling comprising:

a first shear bolt and a second shear bolt, wherein each of the first shear bolt and the second shear bolt comprise a groove thereon defining a shearing plane;

a first adapter, the first adapter having a flange extending radially equally outwardly therefrom, the flange defining a first hole and a second hole therethrough to receive the first shear bolt and the second shear bolt, respectively; and a second adapter, the second adapter having a flange extending radially equally outwardly therefrom, the flange defining a first hole and a second hole therethrough to receive the first shear bolt and the second shear bolt, respectively;

the elongate shaft of the auger system having a material to be sensed located thereon; and a sensor configured to sense the material to be sensed, the sensor placed proximally to the material to be sensed, wherein the sensor and the material to be sensed are located on the first end of the elongate shaft and a motor is attached to the second end of the elongate shaft.

13. The system for detecting the rotational speed of a projectile collection auger of claim 12, wherein the sensor comprises a hall effects sensor and the material to be sensed comprises a magnetic component.

14. The system for detecting the rotational speed of a projectile collection auger of claim 12, wherein the elongate shaft forms part of the discharge screw conveyor.

15. The system for detecting the rotational speed of a projectile collection auger of claim 12, the system further comprising a processor, the processor programmed to calculate the actual rotational speed of the elongate shaft and to receive a programmed rotational speed, and wherein the processor is further programmed to compare the actual rotational speed to the programmed rotational speed and shut down the motor when the actual rotational speed and the programmed rotational speed are not the same.

16. The system for detecting the rotational speed of a projectile collection auger of claim 15, wherein the processor is further programmed to allow a degree of error such that the auger system is shut down when the actual rotational speed and the programmed rotational speed are not within the degree of error.

17. A system for detecting the level of projectiles collected in a projectile collection barrel in an auger projectile collection system, the system comprising:

a projectile transport system for a bullet trap comprising:

a bullet trap having an inlet for receiving projectiles and an outlet for projectiles passing out of the trap, the outlet being disposed adjacent a bottom portion of the bullet trap;

an auger system comprising a discharge screw conveyor disposed in communication with the outlet of the bullet trap, the discharge screw conveyor including a elongate shaft having a first end disposed lower than the outlet of the bullet trap, and a second end disposed higher than the first end, such that the elongate shaft extends upwardly at an angle between horizontal and vertical, and a flighting extending along the elongate shaft from the first end to a position proximal the second end, the auger system further comprising a housing having a rounded bottom, the housing having a housing first end disposed proximal to the first end of the elongate shaft of the discharge screw conveyor, and a housing second end adjacent the second end of the elongate shaft of the discharge screw conveyor, and wherein the housing further comprises an opening in the housing second end for discharging material moved in the housing by the discharge screw conveyor;

and the auger system further comprising a motor unit having a shaft and a shear coupling connecting the elongate shaft of the auger system to the shaft of the motor unit, the shear coupling comprising:

a first shear bolt and a second shear bolt, wherein each of the first shear bolt and the second shear bolt comprise a groove thereon defining a shearing plane;

a first adapter, the first adapter having a flange extending radially equally outwardly therefrom, the flange defining a first hole and a second hole therethrough to receive the first shear bolt and the second shear bolt, respectively; and a second adapter, the second adapter having a flange extending radially equally outwardly therefrom, the flange defining a first hole and a second hole therethrough to receive the first shear bolt and the second shear bolt, respectively;

a projectile collection barrel disposed adjacent the second end of the elongate shaft; and an ultrasonic sensor placed in communication with an interior of the projectile collection barrel, and a processor in communication with the ultrasonic sensor, the processor programmed to receive one or more signals from the ultrasonic sensor indicating the level of projectiles within the projectile collection barrel, and wherein the processor is further programmed to shut down the auger projectile collection system when the processor receives a signal from the ultrasonic sensor indicating the level of projectiles within the collection barrel are above a predetermined threshold.

* * * * *